US005995794A

United States Patent [19]

Osada et al.

[11] Patent Number: 5,995,794

[45] Date of Patent: Nov. 30, 1999

[54] IMAGE FORMING APPARATUS AND INTERMEDIATE TRANSFER BELT

[75] Inventors: Hiroyuki Osada, Numazu; Minoru Shimojo, Kawasaki; Akira Shimada, Shizuoka-ken; Atsushi Tanaka, Susono; Tsunenori Ashibe, Yokohama, all of Japan

[73] Assignee: Canon Kabushiki Kaisha, Tokyo, Japan

[21] Appl. No.: 09/030,163

[22] Filed: Feb. 25, 1998

[30] Foreign Application Priority Data

Feb. 28, 1997 [JP] Japan ..... 9-045719
May 20, 1997 [JP] Japan ..... 9-130017

[51] Int. Cl.[6] ..... G03G 15/16

[52] U.S. Cl. ..... 399/302; 399/308

[58] Field of Search ..... 399/302, 308, 399/49; 430/127, 135, 136

[56] References Cited

U.S. PATENT DOCUMENTS 5,752,130 5/1998 Tanaka et al. ..... 399/308 X
5,842,080 11/1998 Ashibe et al. ..... 399/49

FOREIGN PATENT DOCUMENTS 0596641 5/1994 European Pat. Off. .
0784244 7/1997 European Pat. Off. .
63-301960 12/1988 Japan .
03293385 12/1991 Japan .
05035124 2/1993 Japan .
08063000 3/1996 Japan .
09096941 4/1997 Japan .
10198179 7/1998 Japan .

*Primary Examiner*—Robert Beatty
*Assistant Examiner*—Sophia S. Chen
*Attorney, Agent, or Firm*—Fitzpatrick, Cella, Harper & Scinto

[57] ABSTRACT

An image forming apparatus has a first image bearing member and an intermediate transfer belt onto which a toner image formed on the first image bearing member is primarily transferred is secondarily tranferred onto a second image bearing member. The intermediate tranfer belt has, in its non-image forming region, a tape having a volume resistivity of $10^{10}$ Ω·cm or above, a bond strength of 0.5 kg or above and a breaking extension of 5% or more.

26 Claims, 5 Drawing Sheets

Legend: State(s) of tape after continuous printing - Examples correspond to like-numbered Examples listed in Table 1

| SYMBOL | STATE(S) | EXAMPLES |
|---|---|---|
| ◎ | AA | 1, 2, 3, and 4 |
| ○ | A3 | 7, 9, 11, and 13 |
| □ | A2, A4, A5, and A6 | 6, 8, 10, 12, and 14 |
| △ | B1 and B2 | 15, 16, and 17 |

IMAGE FORMING APPARATUS AND INTERMEDIATE TRANSFER BELT

BACKGROUND OF THE INVENTION

1. Field of the Invention

This invention relates to an image forming apparatus employing an electrophotographic system and also relates to an intermediate transfer belt used therein. More particularly, it relates to an image forming apparatus in which a toner image formed on a first image bearing member is once transferred onto an intermediate transfer belt (primary transfer) and thereafter further transferred onto a second image bearing member (secondary transfer) to obtain an image, and also relates to such an intermediate transfer belt.

2. Related Background Art

Compared with image forming apparatus in which images are transferred from a first image bearing member onto a second image bearing member stuck or attracted onto a transfer drum (Japanese Patent Application Laid-open No. 63-301960, etc.), image forming apparatus making use of an intermediate transfer member have an advantage that the second image bearing member transfer mediums are not required to be worked or controlled (e.g., grasped by grippers, attracted, and made to have a curvature) and hence second image bearing members can be selected in great variety without regard to whether they have large or small widths or lengths, including thin papers (40 g/m$^2$) up to thick papers (200 g/m$^2$) as exemplified by envelopes, postcards and labels.

Because of such an advantage, color copying machines and color printers making use of intermediate transfer members have been made available in the market.

Recently, however, the load placed on printers increases more and more because of environmental problems and computer networking, and there is an increasing demand for higher speed and higher performance of printers. Under such circumstances, when a conventional intermediate transfer belt formed of resin or rubber is repeatedly used while being stretched at any desired tension, electric currents may leak at its edges to cause faulty images.

More specifically any photosensitive drum must be first uniformly electrostatically charged to a predetermined polarity and potential by means of a primary charging assembly in the course of its rotation. Accordingly, as this primary charging assembly, contact type charging assemblies or internal roller type ones are chiefly put into use at present. However, charging assemblies of this type utilize an electrical discharge, which is made to occur at the gap between the charging assembly and the photosensitive drum, and hence, when any photosensitive drum has a portion with a small layer thickness, the electrical discharge tends to localize at that portion because of low resistivity, so that the surface of the photosensitive drum may deteriorate to cause a local scrape.

In particular, this phenomenon tends to occur at non-image forming regions at the edge of the photosensitive drum. This is because photosensitive drums are produced chiefly by a coating process called dipping, and is caused by a small layer thickness at one side f the photosensitive drum side from which the drum begins to be coated. Moreover, as printers are made operable at higher speed, it concurrently becomes necessary to increase the electric currents flowed to primary charging assemblies, and hence the above phenomenon may increasingly occur.

Meanwhile, the intermediate transfer belt is so designed as to have a resin or rubber material layer on its surface so that the desired performance can be exhibited. From the viewpoint of ensuring uniform conductivity and preventing leak, it is usually constituted of a low-resistance conductive elastic layer and provided thereon an outermost layer having a higher resistance than the elastic layer. However, as a result of the use of printers at a high speed or over a long period of time, the high-resistance outermost layer of the intermediate transfer belt may crack or it may come off the elastic layer at the edge having weak strength (non-image forming regions), so that this can be a starting point to a possibility of defects further extending to the inner-part image forming regions.

In particular, most image forming apparatus employing the intermediate transfer belt are provided with some position detecting means on the belt in order to prevent faulty registration (color aberration) of multi-component color images. For example, a method is available in which holes are made in non-image forming regions of the intermediate transfer belt and light is passed through the holes so that the position can be detected with a photosensor. This, however, results in a low strength of the belt around the portions having holes and, as a result of long-term service, the outermost layer may crack or may come off the elastic layer at these portions, to bring about a liability for the low-resistance conductive elastic layer to become laid bare.

Then, once the position where the outermost layer has cracked or lifted at an edge of such a belt has come in agreement with the position where the local scrape has occurred in the photosensitive member, excess electric currents flow from the elastic layer of the intermediate transfer belt. This causes a fall in the voltage applied to the intermediate transfer belt, and hence a portion from which toner is not well transferred may come into being over the whole area of the region at which the intermediate transfer belt comes into contact with the photosensitive member in the latter's longitudinal direction, so that faulty images may be formed. Moreover, excess electric currents flowed to the back electrode of the photosensitive member may cause misoperation or break of electrical control systems of electrophotographic apparatus.

SUMMARY OF THE INVENTION

An object of the present invention is to provide an image forming apparatus that can form good images by the use of an intermediate transfer belt that can solve the above problems. That is, the image forming apparatus may cause no break (peeling of the outermost layer from the elastic layer, or cracking) of the intermediate transfer belt and may cause no faulty images due to the leak caused by these, even when repeatedly used over a long period of time.

The present invention provides an image forming apparatus comprising a first image bearing member and an intermediate transfer belt onto which a toner image formed on the first image bearing member is primarily transferred and through which the toner image thus transferred is secondarily transferred onto a second image bearing member, wherein;

the intermediate transfer belt has, in its non-image forming region, a tape having a volume resistivity of $10^{10}$ Ω·cm or above, a bond strength of 0.5 kg or above and a breaking extension of 5% or more.

The present invention also provides an intermediate transfer belt used in the above image forming apparatus.

DESCRIPTION OF THE PREFERRED EMBODIMENTS

Figure 1:
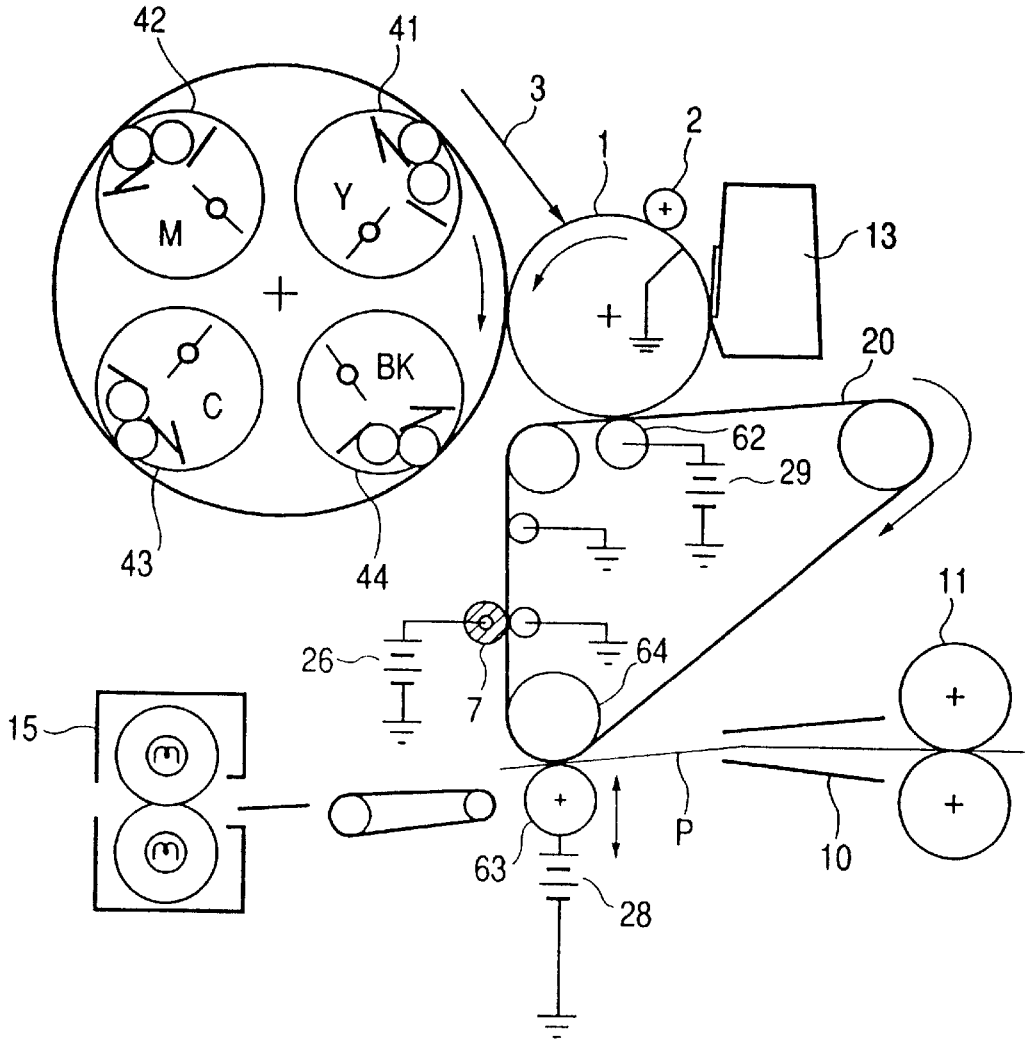
FIG. 1 is a schematic illustration of a full-color image forming apparatus making use of the intermediate transfer belt of the present invention.

The image forming apparatus of the present invention has an intermediate transfer belt onto which a toner image formed on a first image bearing member is primarily transferred and through which the toner image thus transferred is secondarily transferred onto a second image bearing member. The intermediate transfer belt has, in its non-image forming region, a tape having a volume resistivity of $10^{10}$ Ω·cm or above, a bond strength of 0.5 kg or above and a breaking extension of 5% or more.

A reinforcing effect can be expected when an intermediate transfer belt comprised of a resin or rubber is provided with tapes at its edges which are non-image forming regions, or at openings formed in the edges. However, as a result of studies made by the present inventors on trial products of intermediate transfer belts at the non-image forming regions of which tapes of various types have been attached, no satisfactory results were obtained in some cases depending on the properties of the tapes. Accordingly, the present inventors made extensive studies on this point. As a result, they have discovered that the resistance, bond strength and breaking extension of tapes are important factors, and have specified these factors as noted above.

More specifically, the mechanical strength, durability and breakdown strength of the intermediate transfer belt can be improved by controlling the volume resistivity of the tape to be $10^{10}$ Ω·cm or above, the bond strength to be 0.5 kg or above, and the breaking extension to be 5% or more.

In the present invention, a tape base material is bonded through an adhesive to the intermediate transfer belt preferably on its toner image bearing side, or is fused thereto without use of any adhesive.

What is meant by the tape used in the present invention is, in the case when the adhesive is used, the one comprised of the tape base material and the adhesive, and, in the case when the adhesive is not used, the tape base material itself.

The places where the tape is bonded or fused are non-image forming regions such as edges, on which images are not formed. The regions covered with the tape may be the whole area of the edges or part thereof. In an instance where the edges have openings, at least the openings are covered with the tape.

The tape has a volume resistivity of $10^{10}$ Ω·cm or above, and preferably $10^{12}$ Ω·cm or above. If it has a volume resistivity lower than $10^{10}$ Ω·cm, an insufficient breakdown strength may result. From this point of view, in the present invention, it is more preferable for the tape to have a volume resistivity as high as possible, but there is a limit to its measurement at a high precision, which is about $10^{17}$ Ω·cm.

The volume resistivity of the tape in the present invention is a value measured using a resistance measuring device (HIRESTER, a resistance measuring device manufactured by Mitsubishi Yuka; a value given after 5 seconds under application of 100 V).

The tape has a bond strength (when the adhesive is used, as a smaller value either between the intermediate transfer belt and the adhesive or between the adhesive and the base material) of 0.5 kg or above, and preferably 0.75 kg or above. If it has a bond strength lower than 0.5 kg, an insufficient adhesion may result and peeling may occur during use. From this point of view, in the present invention, it is more preferable for the tape to have a bond strength as high as possible, but preferably not higher than 5 kg in view of productivity and heat resistance of materials.

The bond strength is a value measured in accordance with the following:

(1) The intermediate transfer belt is cut into a sample of 25 mm wide and 100 mm long.

(2) To the belt sample thus obtained, a tape cut in a size of 25 mm wide and 200 mm long is bonded under the same conditions in actual use, in such a state that one ends of the both in their longitudinal direction are trued up.

(3) The free portion of the tape is folded by 180 degrees in the opposite direction. Using a tensile tester (TENSILON RTC-1250A, manufactured by Orientec Co.), the belt is inserted to its lower clamp and the tape to its upper clamp, and the both are separated at a rate of 50 mm per minute. Then, after the both begin to be separated, an average value of the force measured at the points of time where the tape has been separated by from 20 mm to 80 mm is calculated.

The tape has a breaking extension of 5% or more, preferably 10% or more, and more preferably 100% or more. If it has a breaking extension less than 5%, there is a problem that, when the belt is stretched, the tape can not follow up the extension to come off or break. From this point of view, in the present invention, it is more preferable for the tape to have a breaking extension as high as possible, but preferably not more than 1,000% in view of too much extension which makes the tape tend to sag.

The breaking extension is a value measured in accordance with ASTM D638.

The base material of the tape used in the present invention may be a sheet of rubber materials as exemplified by ethylene propylene rubber (EPDM), nitrile rubber (NBR), styrene butadiene rubber (SBR), butadiene rubber (BR), isoprene rubber (IR), chloroprene rubber (CR), acrylic rubber (ACM), silicone rubber and fluorine rubber; and resins as exemplified styrene resins (homopolymers or copolymers containing styrene or styrene derivatives) such as polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylate copolymers (e.g., styrene-methyl acrylate copolymer, styrene-ethyl acrylate copolymer, styrene-butyl acrylate copolymer, styrene-octyl acrylate copolymer and styrene-phenyl acrylate copolymer), styrene-methacrylate copolymers (e.g., styrene-methyl methacrylate copolymer, styrene-ethyl methacrylate copolymer and styrene-phenyl methacrylate copolymer), styrene-methyl α-chloroacrylate copolymer and styrene acrylonitrile-acrylate copolymers; methyl methacrylate resin, butyl methacrylate resin, ethyl acrylate resin, butyl acrylate resin, modified acrylic resins (e.g., silicone-modified acrylic resins, vinyl chloride resin-modified acrylic resins and acrylic-urethane resins), vinyl chloride resin, styrene-vinyl acetate copolymer, vinyl chloride-vinyl acetate copolymer, rosin-modified maleic acid resins, phenol resins, epoxy resins, polyester resins, polyester polyurethane resins, polyethylene, polypropylene, polybutadiene, polyvinylidene chloride, ionomer resins, polyurethane resins, silicone resins, fluorine resins, ketone resins, ethylene-ethyl acrylate copolymer, xylene resins, polyvinyl butyral resins, polyamide resins, and modified polyphenylene oxide resins; any of which may be used.

The adhesive may include, e.g., solution types, emulsion types, pressure-sensitive types, remoistening types, polycondensation types, film types or hot melt types of thermosetting resins of epoxy resin types or phenol resin types, thermoplastic resins of polyvinyl acetate types or polyamide types, rubbers of silicone rubber types or polyurethane types, composite resins of rubber-phenol types or epoxy-nylon types, any of which may be appropriately selected taking account of the bond strength between the intermediate transfer belt and the base material.

There are no particular limitations on how to attach the tape to the intermediate transfer belt. For example, the intermediate transfer belt may be covered on a cylindrical mold or the like and a base material coated with a liquid adhesive may be pressed against the surface of the belt, or a filmy adhesive may be put between the base material and the intermediate transfer belt, thus the tape may be attached under prescribed conditions.

When bonded without use of the adhesive, the following methods are available.

(1) Either the tape or a surface layer of the intermediate transfer belt is fused.

(2) Both the tape and the surface layer of the intermediate transfer belt are fused.

The materials may be melted by any means, e.g., by coating a good solvent, or by heating them to their softening temperature or above using a sealer, an ultrasonic welder or the like, whereby either the tape or the surface layer of the intermediate transfer belt or the both of these are melted and put together.

When a higher bond strength is required, the tape base material may preferably be selected from materials having the same properties as a resin used in the surface layer of the intermediate transfer belt.

What is meant by the materials having the same properties is that they belong to the same groups in the classification of resins and rubbers. The resins may include urethane type, epoxy resin type, silicone resin type, unsaturated polyester type, fluorine resin type, polyamide type, polyethylene type, polypropylene type, vinyl chloride type, vinylidene chloride type, polystyrene type, methacrylic resin type, polycarbonate type and polyacetal type. For example, in the case of urethane type, the materials can be regarded as having the same properties, so long as they have urethane bonds in the molecule, which are characteristic of the urethane type. The rubbers may include urethane rubber type, styrene-butadiene rubber type, high styrene rubber type, butadiene rubber type, isoprene rubber type, ethylene-propylene copolymer type, nitrile-butadiene rubber type, chloroprene rubber type, butyl rubber type, silicone rubber type, fluorine rubber type, nitrile rubber type, acrylic rubber type, epichlorohydrin rubber type and norbornene rubber type. Thus, the materials can be regarded as having the same properties, so long as they belong to the same groups in the classification of resins and rubbers.

In the above bonding without use of the adhesive, there are also no particular limitations on how to attach the tape to the intermediate transfer belt. For example, the intermediate transfer belt may be covered on a cylindrical mold or the like, in the state of which the tape may be put thereon and may be fused under prescribed conditions by means of a sealer, a welder or the like.

As described above, the tape may be bonded by any of the adhesion system making use of a liquid adhesive or a hot-melt type adhesive or the fusion system in which no adhesive is used.

When, however, a higher durability is required, the fusion system is preferred to the adhesion system. This is because in the adhesion system the tape may peel from the belt as a result of long-term use, due to adhesive layer deterioration which causes interfacial failure between the belt surface layer and the adhesive layer and between the adhesive layer and the tape and cohesive failure of the adhesive layer, whereas in the fusion system the tape and the surface layer are united or are bonded at a higher strength and hence there is only a very small possibility of peel.

The tape may have any thickness, and may preferably have a thickness ranging from 10 to 1,000 μm. If the tape has a thickness smaller than 1 μm, the reinforcing effect and the effect of improving breakdown strength tend to lower. If it has a thickness larger than 1,000 μm, a large difference in height tends to be produced between the taped portions (non-image forming regions) and the non-taped portions (image forming regions).

Figure 7:
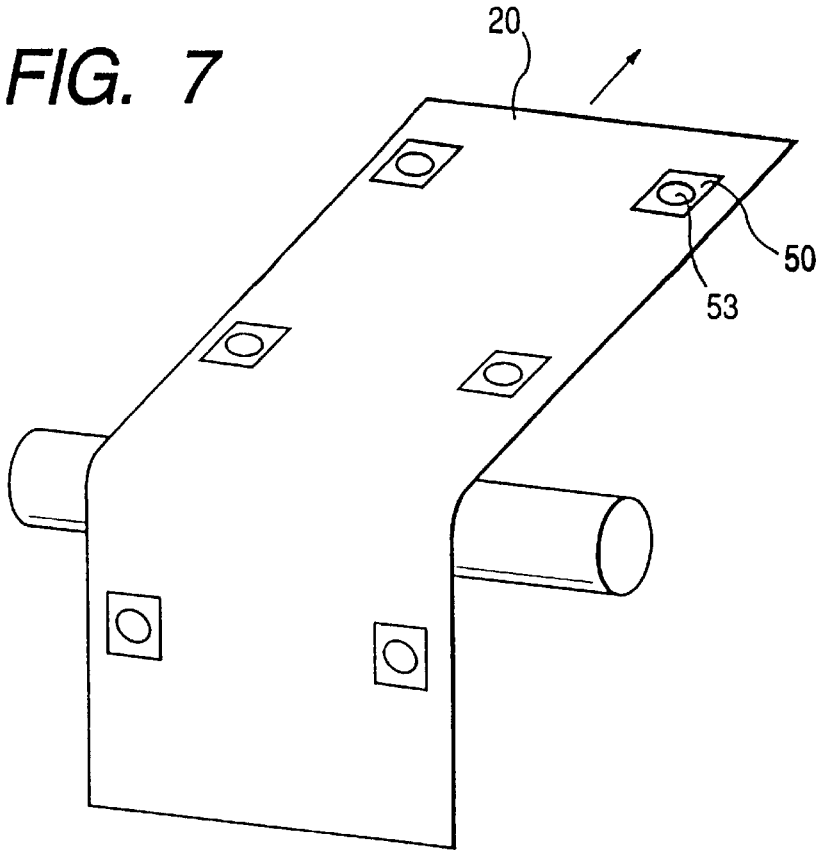
FIG. 7 is a perspective view of the intermediate transfer belt of the present invention, having tapes at openings on the edges.

In an instance where, as previously mentioned, openings 53 intended for the position detection using a photosensor are provided at the edges (side edges) of an intermediate transfer belt 20 and a tape 50 cover each of the openings 53 (see FIG. 7), the tape 50 must have light-transmitting properties at service wavelengths so that the sensor can normally operate.

Figure 8:
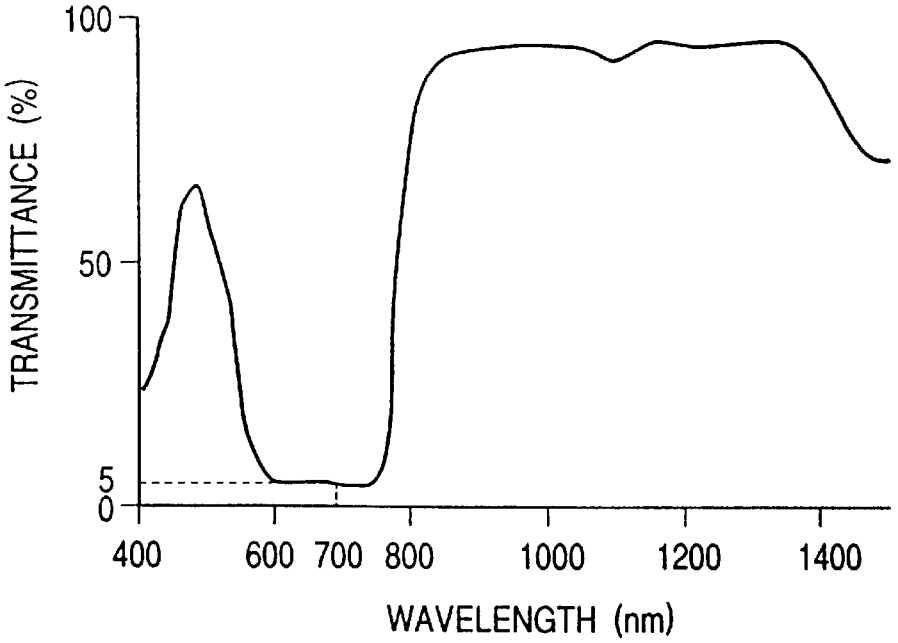
FIG. 8 shows an example of a light transmittance curve.

Stated specifically, the tape may preferably have a light transmittance of 10% or more, and particularly preferably 20% or more, to light with any wavelength of from 700 to 1,500 nm. If it has a light transmittance less than 10%, the sensor may not normally operate to make it difficult to achieve stable and accurate position detection. Here, what is meant by "light transmittance of 10% or more to light with any wavelength of from 700 to 1,500 nm" is that, the tape may have a light transmittance of 10% or more at any wavelength even if it has a light transmittance less 10% at some wavelength as shown in FIG. 8. Stable and accurate position detection can be made when a detecting means is used which makes use of infrared light having a main wavelength in such a wavelength range.

The light transmittance is a value measured using U-3400, an apparatus with a large sample chamber and an integrating sphere, manufactured by Hitachi Ltd.

The intermediate transfer belt of the present invention may be constituted of a single layer or may be constituted of a laminate having a base layer and a surface layer. In the present invention, it may preferably be constituted of the laminate in view of advantages such that the layers can be functionally separated.

In the present invention, the bond strength, represented by Y (kg), and a stress Z (kg) at maximum extension of the surface layer of the intermediate transfer belt may preferably satisfy the following expression:

$Y \geqq 0.5+Z/5$.

In instances where the tape has a great extension stress, a great load is applied also across the tape and the belt surface layer when the intermediate transfer belt is stretched at any tension and extended. Hence, in order for the tape to be durable to long-term use, firm bonding is required. As a result of extensive studies made by the present inventors, the above relationship has been found to be established between the bond strength of the tape and the stress at maximum extension of the surface layer of the intermediate transfer belt. Such maximum extension is the one occurring in a machine in which the intermediate transfer belt is used. For example, usually, a tension is applied to the intermediate transfer belt through several rollers, where the extension of the surface layer of the intermediate tranfer belt reaches a maximum at the contact point (an apex) between it and a roller having the smallest diameter (a larger curvature).

The extension stress refers to a stress at maximum extension of the surface layer of the intermediate transfer belt as measured with a tensile tester using a dumbbell No.3 test piece under conditions of:

Tensile strength: 50 mm/min

Initial distance between two gage marks: 30 mm

There are no particular limitations on how to achieve the respective physical properties in the present invention, which may be achieved by appropriately selecting the materials for the tape base material and adhesive, the manner of bonding, the thickness of the tape and also the materials for the surface layer of the intermediate transfer belt.

Figure 9:
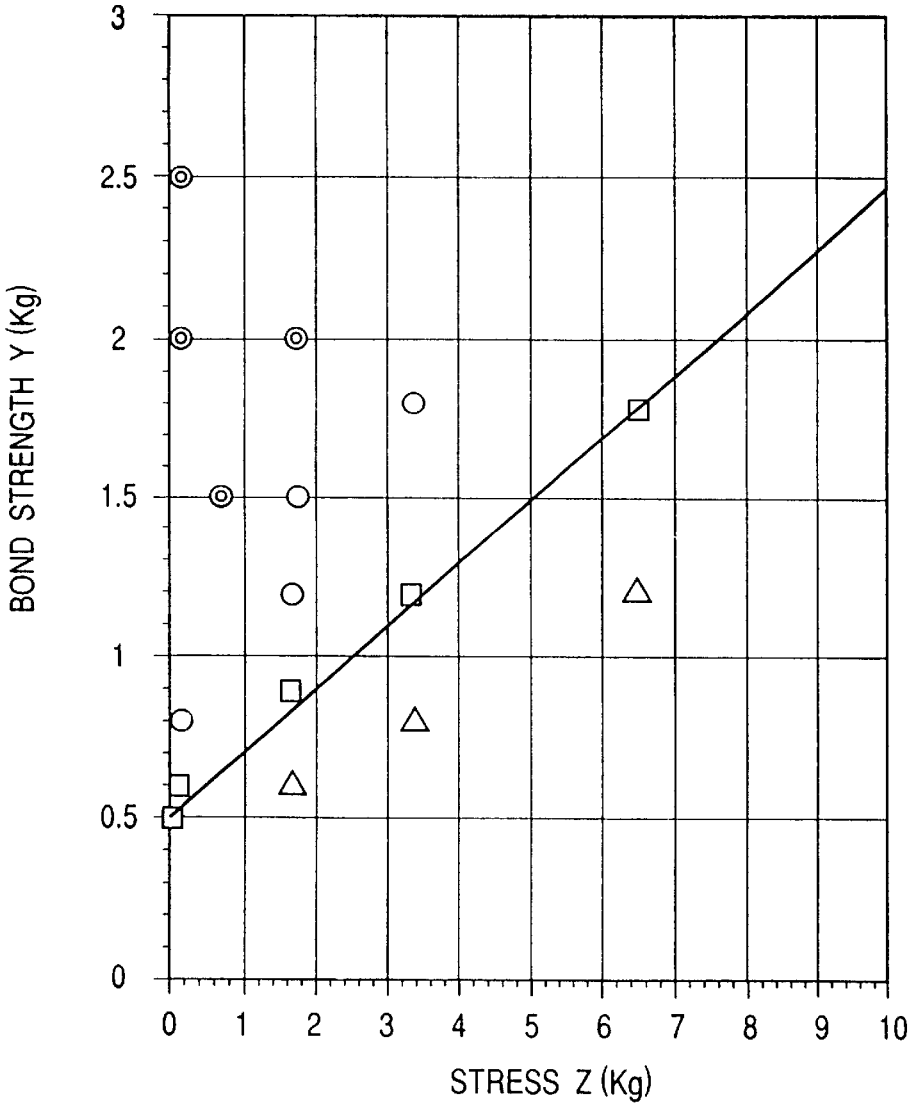
FIG. 9 is a graph showing the relationship between bond strength and stress in the present invention.

FIG. 9 is a graph showing the relationship between the bond strength Y and the stress Z, formed in accordance with the results in Examples given later with the exception of Example 5. As shown therein, the above expression is well in agreement with the results obtained.

Rubbers, elastomers or resins may be used as binders in the base layer and surface layer of the intermediate transfer belt used in the present invention. For example, as the rubbers and elastomers, what may be used is at least one selected from the group consisting of natural rubber, isoprene rubber, styrene-butadiene rubber, butadiene rubber, butyl rubber, ethylene-propylene rubber, ethylene-propylene terpolymers, chloroprene rubber, chlorosulfonated polyethylene, chlorinated polyethylene, acrylonitrile butadiene rubber, urethane rubber, syndiotactic 1,2-polybutadiene, epichlorohydrin rubber, acrylic rubbers, silicone rubbers, fluorine rubbers, polysulfide rubbers, polynorbornene rubber, hydrogenated nitrile rubber, and thermoplastic elastomers (e.g., polystyrene type, polyolefin type, polyvinyl chloride type, polyurethane type, polyamide type, polyester type and fluorine resin type), but not limited to these materials.

As the resins, what may be used is at least one selected from the group consisting of styrene resins (homopolymers or copolymers containing styrene or styrene derivatives) such as polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylate copolymers (e.g., styrene-methyl acrylate copolymer, styrene-ethyl acrylate copolymer, styrene-butyl acrylate copolymer, styrene-octyl acrylate copolymer and styrene-phenyl acrylate copolymer), styrene-methacrylate copolymers (e.g., styrene-methyl methacrylate copolymer, styrene-ethyl methacrylate copolymer and styrene-phenyl methacrylate copolymer), styrene-methyl α-chloroacrylate copolymer and styrene acrylonitrile-acrylate copolymers; methyl methacrylate resin, butyl methacrylate resin, ethyl acrylate resin, butyl acrylate resin, modified acrylic resins (e.g., silicone-modified acrylic resins, vinyl chloride resin-modified acrylic resins and acrylic-urethane resins), vinyl chloride resin, styrene-vinyl acetate copolymer, vinyl chloride-vinyl acetate copolymer, rosin-modified maleic acid resins, phenol resins, epoxy resins, polyester resins, polyester polyurethane resins, polyethylene, polypropylene, polybutadiene, polyvinylidene chloride, ionomer resins, polyurethane resins, silicone resins, fluorine resins, ketone resins, ethylene-ethyl acrylate copolymer, xylene resins, polyvinyl butyral resins, polyamide resins, and modified polyphenylene oxide resins, but not limited to these materials.

A conductive agent may be added in order to adjust the resistance value of the intermediate transfer belt used in the present invention. There are no particular limitations on the conductive agent, and what may be used is, e.g., at least one selected from the group consisting of carbon black, powders of metals such as aluminum and nickel, metal oxides such as titanium oxide, and conductive polymeric compounds such as quaternary ammonium salt-containing polymethyl methacrylate, polyvinyl aniline, polyvinyl pyrrole, polydiacetylene, polyethyleneimine, boron-containing polymeric compounds and polypyrrole, but not limited to these conductive agents.

Various additives can be mixed and dispersed in the binders such as the above various resins, elastomers or rubbers by known methods which may be appropriately used. When the binder components are rubbers or elastomers, apparatus such as roll mills, kneaders and Banbury mixer may be used. When the components are liquid, ball mills, beads mills, homogenizers, paint shakers, Nanomizer or apparatus similar to these may be used to effect dispersion.

The surface layer can be provided on the base layer of the intermediate transfer belt by coating a coating material, e.g., by dipping, roll coating, spray coating or brushing, or by bonding a resin film, but not limited to these.

The surface layer provided on the base layer in the intermediate transfer belt may be a single layer, or may be formed in two or more layers as occasion calls.

The intermediate transfer belt used in the present invention may preferably have a core material layer that constitutes the base layer. This brings about an improvement in mechanical strength of the intermediate transfer belt and perfectly prevents any faulty images from being caused by elongation set.

The role played by the core material layer is to improve the mechanical strength of the intermediate transfer belt. As specific examples of the form of the core material layer, it may be in the form of woven fabric, nonwoven fabric, yarn or film as shown by reference numeral 23 in FIGS. 2 to 4. That is, the core material layer need not necessarily be a continuous layer having no gaps. Thus, the core material layer may have gaps or surface irregularities. Reference numeral 21 denotes the base layer, and 24, coat layers.

As materials constituting the core material layer, what may be used is at least one selected from the group consisting of natural fibers such as cotton, silk, linen and wool, chitin fiber, alginate fiber, regenerated fibers such as regenerated cellulose fiber, semisynthetic fibers such as acetate fiber, synthetic fibers such as polyester fiber, nylon fiber, acrylic fiber, polyolefin fiber, polyvinyl alcohol fiber, polyvinyl chloride fiber, polyvinylidene chloride fiber, polyurethane fiber, polyalkyl paraoxybenzoate fiber, polyacetal fiber, aramid fiber, polyfluoroethylene fiber and phenol fiber, inorganic fibers such as carbon fiber, glass fiber and boron fiber, and metal fibers such as iron fiber and copper fiber. Of course, the materials used in the core material layer in the present invention are by no means limited to these materials.

Figure 2:
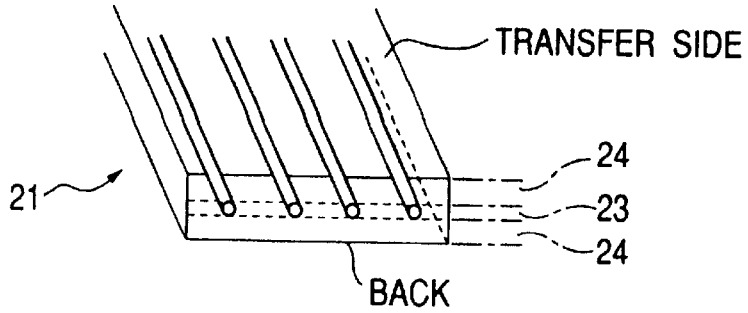
FIG. 2 is a partial schematic illustration of the layer configuration of an intermediate transfer belt of the present invention, having a yarn type core material layer.
Figure 3:
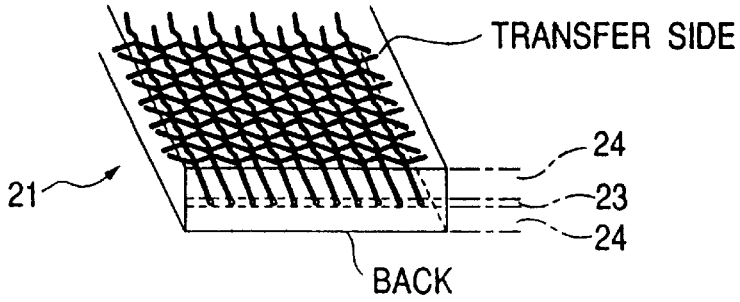
FIG. 3 is a partial schematic illustration of the layer configuration of an intermediate transfer belt of the present invention, having a woven fabric type core material layer.
Figure 4:
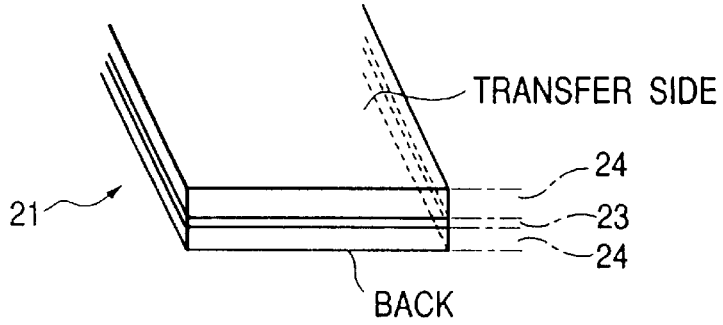
FIG. 4 is a partial schematic illustration of the layer configuration of an intermediate transfer belt of the present invention, having a film type core material layer.

From the viewpoints of readiness in production and production cost, the core material 23 layer may preferably be in the form of a woven fabric or yarn as shown in FIGS. 2 or 3. The yarn may be composed of a single filament or a plurality of filaments twisted together, which latter may be any twisted yarn of single yarn, ply yarn, 2-ply yarn and so forth. It may also be union yarn blended with, e.g., any fibers made of the material shown in the above group of materials. As occasion calls, the yarn may still also be subjected to suitable conductive treatment for its use.

Similarly, as for the woven fabric, any types of woven fabric may be used, as exemplified by knitted cloth, and blended fabric may of course be used. As occasion calls, the woven fabric may also be subjected to suitable conductive treatment for its use.

There are no particular limitations on how to produce the core material layer, and methods can be exemplified by a method in which a woven fabric made into a cylinder is put on a mold or the like and a cover layer 24 is provided thereon, a method in which a woven fabric made into a cylinder is immersed in liquid rubber or the like and a cover layer or layers is/are provided on one side or both sides of the core material layer, a method in which the yarn is wound around a mold or the like in a spiral at any desired pitches and a cover layer is provided thereon. In this instance, what is constituted of the core material layer and the cover layer in combination is regarded as the base layer.

As previously stated, the purpose for which the core material layer is provided in the intermediate transfer belt used in the image forming apparatus of the present invention is to reinforce the intermediate transfer belt. Accordingly, the core material layer may have any thickness, but preferably a thickness ranging from 10 to 500 $\mu$m. If the core material layer has a thickness smaller than 10 $\mu$m, the layer tends to be less effectively reinforced. If it has a thickness larger than 500 $\mu$m, the core material layer may be so excessively rigid as to tend to make it difficult for the intermediate transfer belt to be smoothly driven.

In the case when the core material layer is woven fabric or nonwoven fabric, the thickness of the core material layer in the present invention refers to the value given when the woven fabric or nonwoven fabric that has not been made up into the intermediate transfer belt is measured using a thickness measuring device TH-102 (manufactured by Tester Sangyo K.K.).

In the case when the core material layer is in the form of yarn, the thickness or diameter of yarn is regarded as the thickness of the core material layer. The thickness or diameter of yarn is the value given when the yarn that has not been made up into the intermediate transfer belt is measured using the above thickness measuring device.

In the case when the core material layer is in the form of film, the value given when the thickness of film is measured using the above thickness measuring device is regarded as the thickness of the core material layer. When, however, it can not be measured using the thickness measuring device, the intermediate transfer belt is cut in its thickness direction to microscopically observe the cross section, and the value obtained is regarded as the thickness of the core material layer.

In the case when the core material layer is in the form not applied to any of the foregoing, the intermediate transfer belt is cut in its thickness direction to microscopically observe the cross section, and the value obtained is regarded as the thickness of the core material layer.

The coat layer provided on the top of the core material layer may be a single layer, or may be formed in two or more layers as occasion calls. Especially when a coat layer (an elastic layer) comprised of an elastic material such as rubber or elastomer is provided on the top of the core material layer and a coat layer (an outermost layer) comprised of a resin having good release properties is provided thereon, this elastic layer uniformly and sufficiently ensure the nip required for the primary transfer and secondary transfer and the outermost layer brings about an improvement in transfer efficiency (in particular, secondary transfer efficiency). Thus, such construction is preferred.

The total thickness of the coat layers provided on the top of the core material layer may be a thickness larger than the thickness of the core material layer, which is basic in the present invention. However, too large a thickness is not preferable because the intermediate transfer belt may be so much rigid as to make it difficult for the intermediate transfer belt to be smoothly driven. Accordingly, the total thickness of the coat layers provided on the top of the core material layer may preferably be from 10 $\mu$m to 1,500 $\mu$m.

The intermediate transfer belt may preferably be as thin as possible in view of smoothly driving the belt, and on the other hand may preferably be as thick as possible in view of not damaging the mechanical strength and flexibility of the intermediate transfer belt. Stated specifically, it may preferably have a thickness of from 0.1 mm to 2 mm. In the case when the two coat layers (elastic layer and outermost layer) are provided on the top of the core material layer, the outermost layer may preferably be a layer thin enough not to damage the flexibility of the underlying coat layer. Stated specifically, it may preferably have a thickness of from 1 $\mu$m to 500 $\mu$m, and more preferably from 5 $\mu$m to 200 $\mu$m.

The thickness of these various layers can also be measured in the same manner as that of the core material layer.

In the present invention, if the intermediate transfer belt has too high a resistivity, a developer having been primarily transferred before developers of second and subsequent colors are primarily transferred may return to the first image bearing member when the latter is primarily transferred, tending to make it impossible to obtain images with the intended hues.

If on the other hand the intermediate transfer belt has too low a resistivity, the intermediate transfer belt tends to have a great difference in resistivity between its areas having undergone primary transfer and areas not having done it. If it occurs, the developers of second and subsequent colors can no longer be transferred with good efficiency, also making it impossible to obtain images with the intended hues. Accordingly, the intermediate transfer belt may preferably have a resistivity within the range of from $1\times10^4$ Ω to $1\times10^{11}$ Ω, as measured in the manner described below.

Figure 5:
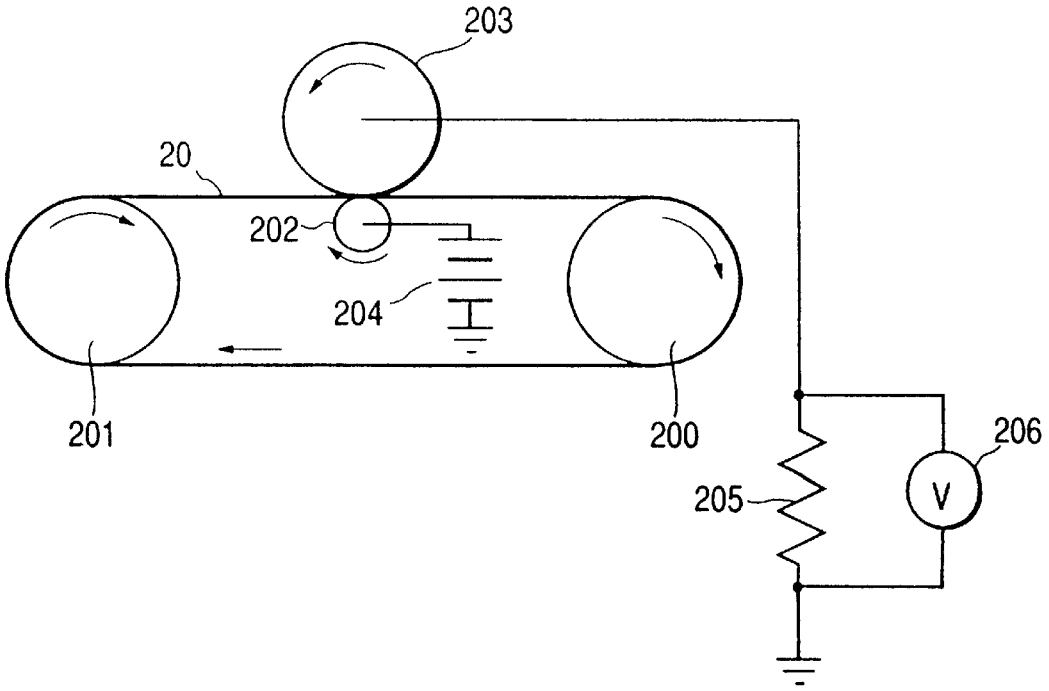
FIG. 5 schematically illustrates a device for measuring the resistance of the intermediate transfer belt of the present invention.

Measurement of resistivity of intermediate transfer belt:

(1) As shown in FIG. 5, the intermediate transfer belt (20) is stretched on rollers 200 and 201 and the intermediate transfer belt is set to be held between two metal rollers 202 and 203, and a DC power source 204, a resistor 205 having a suitable resistance and a potentiometer 206 are connected.

(2) The intermediate transfer belt is so driven by means of a drive roller 200 as to be at a belt surface movement speed of from 100 to 300 mm/second.

(3) A voltage (+1 kV) is applied from the DC power source to the circuit, and potential difference Vr at the both ends of the resistor is read on the potentiometer. When measured, the atmosphere is controlled at a temperature of 23±5° C. and a humidity of 50±10%RH.

(4) Current value I of the current flowing through the circuit is determined from the resulting potential difference VI.

(5) Resistivity of intermediate transfer belt=applied voltage (+1 kV)/current value I A higher primary transfer efficiency can be achieved when a photosensitive drum containing fine powder of polytetrafluoroethylene (PTFE) at least in its outermost layer is used as the first image bearing member. Hence, such measure is preferred. It is presumed that the incorporation of the fine powder of PTFE makes the surface energy of the photosensitive drum outermost layer lower to improve the release properties of toner.

A color image forming apparatus according to the present invention which utilizes an electrophotographic process is shown in FIG. 1 as a schematic illustration of its constitution.

Reference numeral 1 denotes a drum-shaped electrophotographic photosensitive member (hereinafter "photosensitive drum") serving as the first image bearing member, and is rotated in the direction of an arrow at the preset peripheral speed (process speed).

The photosensitive drum 1 is, in the course of its rotation, uniformly electrostatically charged to the predetermined polarity and potential by means of a primary charging assembly 2, and then subjected to exposure to light 3 emitted from an imagewise exposure means 3 (not shown; an exposure optical system for the color separation/image formation of color original images, or a scanning exposure system employing a laser scanner that outputs laser beams modulated in accordance with time-sequential electrical digital pixel signals of image information). Thus, an electrostatic latent image is formed which corresponds to a first color component image (e.g., yellow color component image) of the intended color image.

Next, the electrostatic latent image is developed with first-color yellow toner (YLW) by means a first developing assembly (yellow developing assembly 41). In that course, second to fourth developing assemblies (magenta (M) color developing assembly 42, cyan (C) color developing assembly 43 and black (BK) color developing assembly 44) are not actuated and do not act on the photosensitive drum 1. Hence, first-color yellow toner images are not affected by the second to fourth developing assemblies.

An intermediate transfer member 20 is rotatingly driven in the direction of an arrow at the preset peripheral speed.

In the course where the first-color yellow toner images formed and held on the photosensitive drum 1 pass through the nip between the photosensitive drum 1 and the intermediate transfer belt 20, they are successively intermediately transferred to the periphery of the intermediate transfer belt 20 (primary transfer) by the aid of an electric field formed by primary transfer bias applied to the intermediate transfer belt 20 from a primary transfer roller 62.

The surface of the photosensitive drum 1 on which the transfer of the first-color yellow toner images has been completed is cleaned by a cleaning assembly 13.

Subsequently, second-color magenta toner images, third-color cyan toner images and fourth-color black toner images are successively superimposingly transferred onto the intermediate transfer belt 20, thus the intended full-color toner image is formed.

Reference numeral 63 denotes a secondary transfer roller, which is so provided that it is axially supported in parallel to a secondary transfer counter roller 64 and is separable at a distance from the bottom surface of the intermediate transfer member 20.

The primary transfer bias for successively superimposingly transferring the first- to fourth-color toner images from the photosensitive drum 1 to the intermediate transfer belt 20 has a polarity reverse to that of the toners, and is applied from a bias power source 29. Its applied voltage is in the range of, e.g., from +100 V to +2 kV.

In the course of the primary transfer, the secondary transfer roller 63 and a charging assembly 7 connected to bias power source 26 for cleaning are kept apart from the intermediate transfer belt 20.

The full-color toner image formed on the intermediate transfer belt 20 is transferred to the second image bearing member, transfer medium P, in the following way: The secondary transfer roller 63 is brought into contact with the intermediate transfer belt 20 and also the transfer medium P is fed through a paper feed roller 10 passed paper feeding guide 11 to the contact nip between the intermediate transfer belt 20 and the secondary transfer roller 63 at a given timing, where the secondary transfer bias is applied to the secondary transfer roller 63 from the bias power source 28. The transfer medium P on which the full-color toner image has been transferred is guided into a fixing assembly 15, and is heated and fixed there.

After the transfer of the toner image to the transfer medium P has been completed, the charging assembly 7 for cleaning is brought into contact with the intermediate transfer belt 20 to apply a bias with a polarity reverse to that of the photosensitive drum 1, so that charges with a polarity reverse to that of the photosensitive drum 1 is imparted to the toner not transferred to the transfer medium P and remaining on the intermediate transfer belt 20 (the transfer residual toner).

The transfer residual toner is electrostatically transferred to the photosensitive drum 1 at the nip between the photosensitive drum 1 and the intermediate transfer belt 20 and in the vicinity thereof, so that the intermediate transfer belt is cleaned.

The intermediate transfer belt may be cleaned by any cleaning means such as blade cleaning, fur-brush cleaning, electrostatic cleaning or combination of some of these. From the viewpoint of making apparatus compact and cost reduction, a preferred cleaning system may include, e.g., the system as shown in FIG. 1, in which the transfer residual toner or developer is electrostatically transferred to the photosensitive drum 1. In FIG. 1, a cleaning charging assembly 7 may have any form of various types such as a metal roll, an elastic roll with a conductivity, a fur brush with a conductivity and a blade with a conductivity.

In the image forming apparatus shown in FIG. 1, the transfer residual toner or developer occurred in the previous image forming step and present on the intermediate transfer belt 20 may be returned to the photosensitive drum 1 at the same time when the toner or developer is primarily transferred from the photosensitive drum 1 to the intermediate transfer belt (hereinafter "primary transfer simultaneous cleaning system"). The primary transfer simultaneous cleaning system does not require any particular cleaning step, and has an advantage that it is free from a decrease in throughput.

Figure 6:
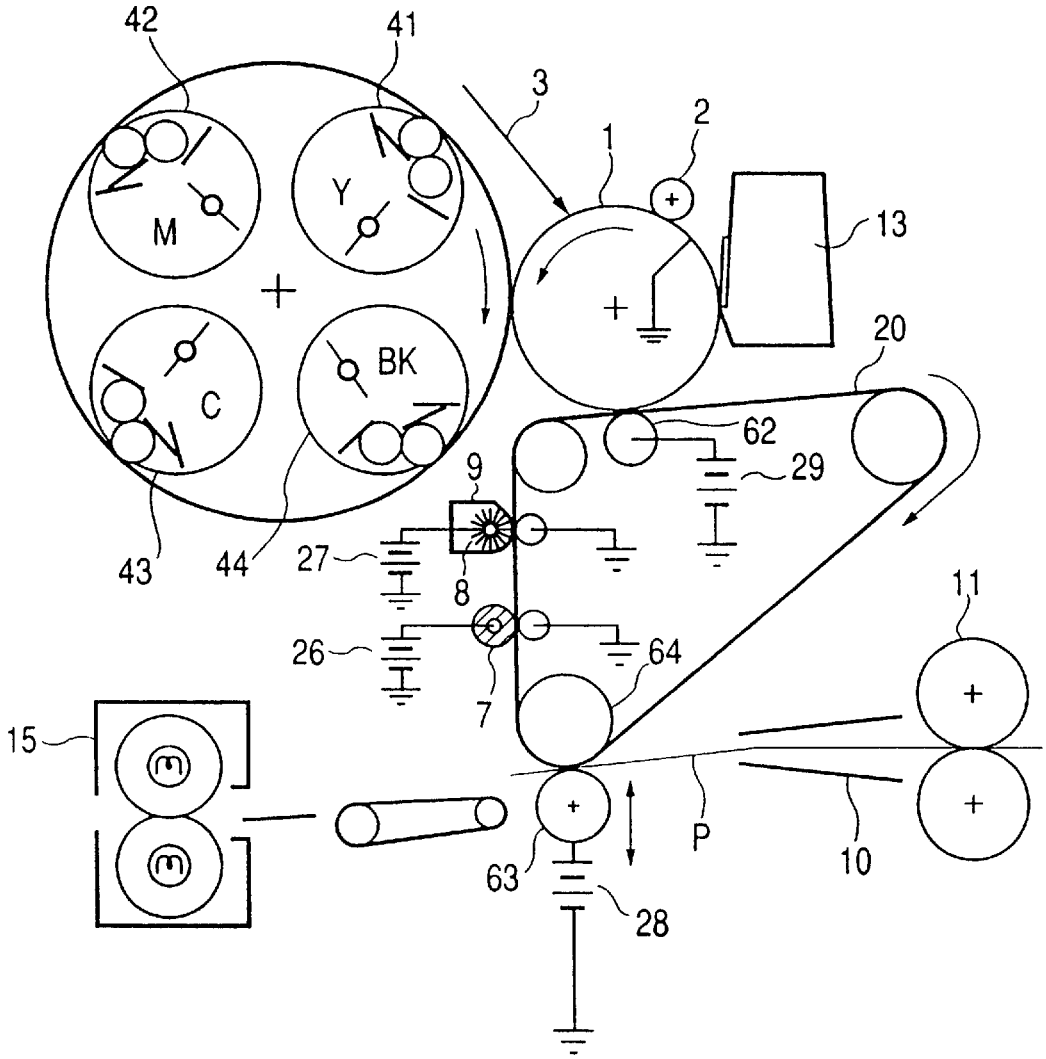
FIG. 6 is a schematic illustration of another full-color image forming apparatus making use of the intermediate transfer belt of the present invention.

As also shown in FIG. 6, a transfer residual toner or developer collecting member 8, connected to bias power source 27, may be provided. This transfer residual toner or developer collecting member 8 may also have any form of various types such as a metal roll, an elastic roll with a conductivity, a fur brush with a conductivity and a blade with a conductivity. Here, a voltage with a polarity reverse to the voltage applied to the cleaning charging assembly 7 may be applied to the transfer residual toner or developer collecting member 8 so that the transfer residual toner or developer can be removed by electrostatic cleaning.

In the apparatus shown in FIG. 6, it may also be contemplated that, e.g., a bias with a polarity reverse to that of the photosensitive drum 1 may be applied to the transfer residual toner or developer collecting member 8 at the time of switching-on so that the transfer residual toner or developer can be collected in the cleaning assembly 13 of the photosensitive drum. This system has an advantage that a collecting container 9 for the transfer residual toner or developer can be made compact.

EXAMPLES

The present invention will be described below in greater detail by giving Examples.

Example 1

A rubber compound formulated as shown below was put around a cylindrical mold in a uniform thickness of 0.4 mm, and nylon yarn (diameter: 100 μm) surface-coated with an adhesive was wound around it in a spiral at a pitch of 1 mm. A rubber compound formulated as shown below, previously extruded in the shape of a tube, was further covered thereon, followed by vulcanization and polishing to obtain a rubber belt (the base layer) interlayed with a core material layer of 0.8 mm thick, having a 0.3 mm thick elastic layer and a 0.4 mm thick elastic layer on the top and back, respectively, of the core material layer.

| | (by weight) |
|---|---|
| Rubber composition: | |
| SBR rubber | 30 parts |
| EPDM rubber | 70 parts |
| Vulcanizing agent (precipitated sulfur) | 1.5 parts |
| Vulcanizing auxiliary (zinc white) | 2 parts |
| Vulcanizing accelerator (MBT) | 1.5 parts |
| Vulcanizing accelerator (TMTM) | 1.2 parts |
| Conductive agent (carbon black) | 25 parts |
| Dispersing agent (stearic acid) | 1 part |
| Plasticizer (naphthene type process oil) | 40 parts |
| Next, a coating material used to form a single-layer coat layer (surface layer) on the rubber belt was prepared in the following formulation. | |
| Coating material composition: | |
| Polyurethane prepolymer | 100 parts |
| Fine PTFE resin powder | 70 parts |
| Methyl ethyl ketone | 400 parts |
| N-methylpyrrolidone | 50 parts |

The above coating material was spray-coated on the rubber belt, and the coating formed was dried to the touch, followed by heating at 120° C. for 2 hours to remove the remaining solvent. Thus, an intermediate transfer belt having a coat layer (surface layer) of 30 μm thick was obtained. The intermediate transfer belt thus obtained had a resistivity of $2\times10^6$ Ω.

Holes of 5 mm square were also made at four points in the non-image forming regions on the belt edges, and a tape cut in 15 mm square and having a thickness of 100 μm and the following constitution and properties was stuck to each opening, using an ultrasonic fusing machine (BRANSON 900M series ultrasonic welder, manufactured by Emason Japan Ltd.) under bonding conditions of a fusion energy of 100 J and a pressure of 10 kg/cm$^2$. The bonded portions were examined to make sure that both the tape and the intermediate transfer belt surface layer were melted and joined together.

Base material: Urethane resin (thickness: 100 μm)
Volume resistivity: $10^{12}$ Ω·cm
Bond strength: 1.5 kg
Breaking extension: 500%
Light transmittance (960 nm): 90%
Stress: 0.2 kg This intermediate transfer belt was set in the full-color electrophotographic apparatus shown in FIG. 1, and full-color images were printed on 150,000 sheets of paper in an environment of low temperature/low humidity of temperature 15° C./humidity 10% RH. Results obtained are shown in Table 1.

In the present Example, the images were formed under conditions shown below.

Non-image area surface potential: −550 V
Image area surface potential: −150 V
Color developers (four colors in common): Non-magnetic one-component toners
Primary transfer voltage: +500 V
Secondary transfer voltage: +1,500 V
Process speed: 120 mm/sec.
Development bias: Vdc: −400 V
Vac: 1,600 Vpp
Frequency: 1,800 Hz

Example 2

An intermediate transfer belt was prepared in the same manner as in Example 1 except that the tape was replaced with the one having the following constitution and properties. Evaluation was also made similarly. Results obtained are shown in Table 1.

Base material: Polyethylene terephthalate (PET) (thickness: 25 μm)
Volume resistivity: $10^{15}$ Ω·cm
Bond strength: 2.0 kg
Breaking extension: 120%
Light transmittance (960 nm): 95%
Stress: 1.7 kg

Example 3

An intermediate transfer belt was prepared in the same manner as in Example 1 except that the surface layer coating material was formulated as shown below.

| Coating material composition: | (by weight) |
|---|---|
| Polyurethane prepolymer | 100 parts |
| Curing agent (isocyanate) | 4 parts |
| Fine PTFE resin powder | 70 parts |
| Methyl ethyl ketone | 400 parts |
| N-methylpyrrolidone | 50 parts |

The intermediate transfer belt thus obtained had a resistivity of $2\times10^6$ Ω.

The intermediate transfer belt was further finished in the same manner as in Example 1 except that the tape was replaced with the one having the following constitution and properties. Evaluation was also made similarly. Results obtained are shown in Table 1.

Example 4

An intermediate transfer belt was prepared in the same manner as in Example 3 except that the tape having the following constitution and properties was stuck using a heat sealer (manufactured by Shinwa Kikai K.K.) under bonding conditions of a hot plate temperature of 110° C., a pressure of 3 kg/cm$^2$ and a time of 20 seconds. Evaluation was also made similarly. Results obtained are shown in Table 1.

Tape used in Examples 3 and 4

Base material: Fluorine resin (thickness: 50 μm)

Adhesive: Acrylic heat-sensitive adhesive film (thickness: 50 μm)

Volume resistivity: $10^{15}$ Ω·cm

Bond strength: 1.5 kg (peel between the intermediate transfer belt and the adhesive)

Breaking extension: 300%

Light transmittance (960 nm): 95%

Stress: 0.6 kg

Examples 5 to 17

Intermediate transfer belts were prepared in the same manner as in Example 4 except that the tape was replaced with the ones shown in Table 1. Evaluation was also made similarly. Results obtained are shown in Table 1.

Comparative Example 2

An intermediate transfer belt was prepared in the same manner as in Example 4 except that the tape was replaced with the one having the following constitution and properties. Evaluation was also made similarly.

Results obtained are shown in Table 1.

Base material: Urethane resin (thickness: 100 μm)

Adhesive: Olefin type heat-sensitive adhesive film (thickness: 50 μm)

Volume resistivity: $10^{12}$ Ω·cm

Bond strength: 0.3 kg

Breaking extension: 500%

Light transmittance: 90%

Stress: 0.2 kg

TABLE 1

| | Base material | | Adhesion | | Volume | | Breaking | Light- | | |
|---|---|---|---|---|---|---|---|---|---|---|
| | Material resin | Thickness (μm) | Type of material | Thickness (μm) | resistivity (Ω · cm) | Bond strength (kg) | extention (%) | transmittance (%) | Stress (kg) | (1) |
| Example: | | | | | | | | | | |
| 1 | Urethane resin | 100 | — | — | $10^{12}$ | 2.5 | 500 | 90 | 0.2 | AA |
| 2 | PET | 25 | — | — | $10^{15}$ | 2.0 | 120 | 95 | 1.7 | AA |
| 3 | Urethane resin | 100 | — | — | $10^{12}$ | 2.0 | 500 | 90 | 0.2 | AA |
| 4 | Fluorine resin | 50 | Acrylic | 50 | $10^{15}$ | 1.5 | 300 | 95 | 0.6 | AA |
| 5 | Hydrin rubber | 50 | Acrylic | 50 | $10^{10}$ | 2.0 | 750 | 60 | 0.05 | A1 |
| 6 | Silicone rubber | 50 | Acrylic | 50 | $10^{15}$ | 0.5 | 300 | 70 | 0.02 | A2 |
| 7 | Acrylic resin | 100 | Acrylic | 50 | $10^{15}$ | 1.5 | 140 | 90 | 1.8 | A3 |
| 8 | Urethane resin | 100 | Chloroprene rubber | 50 | $10^{12}$ | 0.6 | 500 | 90 | 0.2 | A4 |
| 9 | Urethane resin | 100 | Ester | 50 | $10^{12}$ | 0.8 | 500 | 90 | 0.2 | A3 |
| 10 | PET | 25 | Urethane | 50 | $10^{15}$ | 0.9 | 120 | 95 | 1.7 | A5 |
| 11 | PET | 25 | Acrylic | 50 | $10^{15}$ | 1.2 | 120 | 95 | 1.7 | A3 |
| 12 | PET | 50 | Acrylic | 50 | $10^{15}$ | 1.2 | 120 | 95 | 3.4 | A5 |
| 13 | PET | 50 | Ester | 50 | $10^{15}$ | 1.8 | 120 | 95 | 3.4 | A3 |
| 14 | PET | 100 | Ester | 50 | $10^{15}$ | 1.8 | 120 | 95 | 6.5 | A6 |
| 15 | PET | 25 | Chloroprene rubber | 50 | $10^{15}$ | 0.6 | 120 | 95 | 1.7 | B1 |
| 16 | PET | 50 | Urethane | 50 | $10^{15}$ | 0.8 | 120 | 95 | 3.4 | B2 |
| 17 | PET | 100 | Acrylic | 50 | $10^{15}$ | 1.2 | 120 | 95 | 6.5 | B2 |
| Comparative Example: | | | | | | | | | | |
| 1 | Urethane resin | 100 | — | — | $10^{9}$ | 2.5 | 500 | 90 | 0.2 | C1 |
| 2 | Urethane resin | 100 | Olefin | 50 | $10^{12}$ | 0.3 | 500 | 90 | 0.2 | C2 |

(1): State of tape after continuous printing

AA: No change during 150,000 sheet printing; A1: Slight leak on 140,000th sh.; A2: Peeling on 140,000th sh.; A3: Lifting on 150,000th sh.; A4: Peeling on 130,000 sh.; A5: Peeling on 120,000th sh.; A6: Peeling on 110,000th sh.; B1: Peeling on 90,000th sh.; B2: Peeling on 80,000th sh.; C1: Leak on 50,000th sh.; C2: Peeling on 60,000th sh.

Comparative Example 1

An intermediate transfer belt was prepared in the same manner as in Example 1 except that the tape was replaced with the one having the following constitution and properties. Evaluation was also made similarly. Results obtained are shown in Table 1.

Base material: Lithium perchlorate-containing urethane resin (thickness: 100 μm)

Volume resistivity: $10^{9}$ Ω·cm

Bond strength: 2.5 kg

Breaking extension: 500%

Light transmittance: 90%

Stress: 0.2 kg

What is claimed is:

1. An image forming apparatus comprising a first image bearing member and an intermediate transfer belt onto which a toner image formed on the first image bearing member is primarily transferred and through which the toner image thus transferred is secondarily transferred onto a second image bearing member, wherein;

said intermediate transfer belt has, in its non-image forming region, a tape having a volume resistivity of $10^{10}$ Ω·cm or above, a bond strength of 0.5 kg or above and a breaking extension of 5% or more.

2. The image forming apparatus according to claim 1, wherein said intermediate transfer belt has an opening at its non-image forming region, and said tape covers at least the opening.

3. The image forming apparatus according to claim 1 or 2, wherein said volume resistivity is $10^{12}$ Ω·cm or above.

4. The image forming apparatus according to claim 1 or 2, wherein said bond strength is 0.75 kg or above.

5. The image forming apparatus according to claim 1 or 2, wherein said breaking extension is 10% or more.

6. The image forming apparatus according to claim 5, wherein said breaking extension is 100% or more.

7. The image forming apparatus according to claim 2, wherein said tape has a light transmittance of 10% or more to light with any wavelength of from 700 to 1,500 nm.

8. The image forming apparatus according to claim 1 or 2, wherein the bond strength, represented by Y (kg), and a stress Z (kg) at maximum extension of a surface layer of said intermediate transfer belt satisfies the following expression:

$$Y \geqq 0.5+Z/5.$$

9. The image forming apparatus according to claim 1 or 2, wherein said tape has a tape base material and an adhesive.

10. The image forming apparatus according to claim 1 or 2, wherein said tape is fused to said intermediate transfer belt.

11. The image forming apparatus according to claim 1 or 2, wherein said intermediate transfer belt has a resistivity of from $1\times10^{4}$ Ω to $1\times10^{11}$ Ω.

12. The image forming apparatus according to claim 1 or 2, wherein said intermediate transfer belt has a base layer and a surface layer.

13. The image forming apparatus according to claim 1 or 2, wherein said first image bearing member is an electrophotographic photosensitive member.

14. An intermediate transfer belt onto which a toner image formed on a first image bearing member is primarily transferred and through which the toner image thus transferred is secondarily transferred onto a second image bearing member; said intermediate transfer belt comprising;

a belt having, in its non-image forming region, a tape having a volume resistivity of $10^{10}$ Ω·cm or above, a bond strength of 0.5 kg or above and a breaking extension of 5% or more.

15. The intermediate transfer belt according to claim 14, which has an opening at its non-image forming region, and said tape covers at least the opening.

16. The intermediate transfer belt according to claim 14 or 15, wherein said volume resistivity is $10^{12}$ Ω·cm or above.

17. The intermediate transfer belt according to claim 14 or 15, wherein said bond strength is 0.75 kg or above.

18. The intermediate transfer belt according to claim 14 or 15, wherein said breaking extension is 10% or more.

19. The intermediate transfer belt according to claim 18, wherein said breaking extension is 100% or more.

20. The intermediate transfer belt according to claim 15, wherein said tape has a light transmittance of 10% or more to light with any wavelength of from 700 to 1,500 nm.

21. The intermediate transfer belt according to claim 14 or 15, wherein the bond strength, represented by Y (kg), and a stress Z (kg) at maximum extension of a surface layer of the intermediate transfer belt satisfies the following expression:

$$Y \geqq 0.5+Z/5.$$

22. The intermediate transfer belt according to claim 14 or 15, wherein said tape has a tape base material and an adhesive.

23. The intermediate transfer belt according to claim 14 or 15, wherein said tape is fused to said intermediate transfer belt.

24. The intermediate transfer belt according to claim 14 or 15, which has a resistivity of from $1\times10^{4}$ Ω to $1\times10^{11}$ Ω.

25. The intermediate transfer belt according to claim 14 or 15, which has a base layer and a surface layer.

26. The intermediate transfer belt according to claim 14 or 15, wherein said first image bearing member is an electrophotographic photosensitive member.

* * * * *

UNITED STATES PATENT AND TRADEMARK OFFICE

CERTIFICATE OF CORRECTION

PATENT NO. : 5,995,794
DATED : November 30, 1999
INVENTOR(S) : Hiroyuki Osada et al.

It is certified that error appears in the above-identified patent and that said Letters Patent is hereby corrected as shown below:

Item [56] FOREIGN PATENT DOCUMENTS:
"03293385" should read -- 3-293385 --.
"05035124" should read -- 5-035124 --.
"08063000" should read -- 8-063000 --.
"09096941" should read -- 9-096941 --.
"10198179" should read -- 10-198179 --.

Item [57] ABSTRACT,
Line 4, "transferred" should read -- transferred; --.

Column 1,
Line 41, "specifically" should read -- specifically, --.
Line 59, "f" should read -- of --.

Column 2,
Line 4, "an" should read -- on an --.

Column 4,
Line 29, "one" should read -- on --.
Line 30, "are" should read -- is --.
Lines 35 and 36, "the" should be deleted.

Column 8,
Line 5, "rosin-modified" should read -- resin-modified --.

Column 11,
Line "VI." should read -- Vr. --.

Signed and Sealed this

Twenty-fifth Day of December, 2001

*Attest:*

*Attesting Officer*

JAMES E. ROGAN
*Director of the United States Patent and Trademark Office*